United States Patent [19]

Otobe et al.

[11] 4,434,769

[45] Mar. 6, 1984

[54] DECELERATION FUEL CUT DEVICE FOR INTERNAL COMBUSTION ENGINES

[75] Inventors: Yutaka Otobe, Shiki; Akihiro Yamato, Sayama; Shigeo Umesaki, Iruma, all of Japan

[73] Assignee: Honda Motor Co., Ltd., Tokyo, Japan

[21] Appl. No.: 379,187

[22] Filed: May 17, 1982

[30] Foreign Application Priority Data

May 20, 1981 [JP] Japan ..... 56-75847

[51] Int. Cl.[3] ..... F02B 3/00

[52] U.S. Cl. ..... 123/493; 123/492; 123/494

[58] Field of Search ..... 123/493, 492, 494, 478, 123/480, 481, 325

[56] References Cited

U.S. PATENT DOCUMENTS

| | | | |
|---|---|---|---|
| 3,727,591 | 4/1973 | Suda | 123/493 |
| 3,916,170 | 10/1975 | Norimatsu et al. | 123/493 |
| 4,133,326 | 1/1979 | Cops et al. | 123/493 |
| 4,245,605 | 1/1981 | Rice et al. | 123/493 |
| 4,257,363 | 3/1981 | Zeller | 123/493 |
| 4,274,382 | 6/1981 | Sugusawa et al. | 123/493 |
| 4,356,803 | 11/1982 | Miyagi | 123/493 |

*Primary Examiner*—Raymond A. Nelli
*Attorney, Agent, or Firm*—Arthur L. Lessler

[57] ABSTRACT

A deceleration fuel cut device adapted to interrupt the supply of fuel to an internal combustion engine when a detected actual engine rotational speed is higher than a predetermined value, and simultaneously a detected intake pipe pressure is lower than a predetermined value. The predetermined engine speed value is set to lower values as the detected actual engine temperature increases. The predetermined intake pipe pressure value is determined as a function of the detected actual engine speed. The predetermined intake pipe pressure value and/or the predetermined engine speed value may be set at different values between the time of initiation of cutting off the fuel supply and the time of termination of same, to impart a hysteresis characteristic to the fuel cut operation.

5 Claims, 13 Drawing Figures

FIRST PROGRAM
1
SECOND PROGRAM
2
START CONTROL
3
BASIC CONTROL
4
ASYNCHRONOUS CONTROL
5
TiCRM,TiCRS TABLES
6,7
KNe TABLE
8
TV TABLE
9
BASIC Ti MAP
10
ACC/DEC SUBROUTINE
11
COEFFICIENT CALCULATING TABLES, SUBROUTINES
12
TV TABLE
9
TiA TABLE
13
KTW TABLE
14
TV TABLE
9

DECELERATION FUEL CUT DEVICE FOR INTERNAL COMBUSTION ENGINES

BACKGROUND OF THE INVENTION

This invention relates to a fuel supply control system for internal combustion engines, and more particularly to a deceleration fuel cut device provided in a fuel supply control system of this kind, for performing a fuel cut operation at engine deceleration.

A fuel supply control system adapted for use with an internal combustion engine, particularly a gasoline engine has been proposed e.g. by U.S. Pat. No. 3,483,851, which is adapted to determine the valve opening period of a fuel quantity metering or adjusting means for control of the fuel injection quantity, i.e. the air/fuel ratio of an air/fuel mixture being supplied to the engine, by first determining a basic value of the above valve opening period as a function of engine rpm and intake pipe absolute pressure and then adding to and/or multiplying same by constants and/or coefficients being functions of engine rpm, intake pipe absolute pressure, engine temperature, throttle valve opening, exhaust gas ingredient concentration (oxygen concentration), etc., by electronic computing means.

On the other hand, in these days there is a tendency for automobile fuel cost to gradually increase. To cope with this tendency, it has conventionally been employed to cut off the supply of fuel to the engine at engine deceleration, for reduction of the fuel consumption. Detection of a decelerating condition of the engine for carrying out the fuel cut is conventionally made on the basis of the opening of a throttle valve in the intake pipe of the engine, and when the throttle valve opening is decreased below a predetermined opening (almost equal to full closing of the valve) and simultaneously the engine rotational speed is higher than a predetermined rotational speed, the fuel cut is carried out.

To detect the opening of the throttle valve, generally used is a potentiometer which is connected to the valve body of the throttle valve or a sensor adapted to detect negative pressure in the intake pipe of the engine through a negative pressure intake port arranged to open in the intake pipe at a location slightly upstream of the throttle valve in its full closing position. However, it is very difficult to accurately detect the opening of the throttle valve by means of the above type sensors or the like, when the throttle valve is in almost full closing position, thus making it difficult to carry out a proper fuel cut operation.

On the other hand, if the intake pipe pressure at which the fuel cut is to be effected is too low, the engine can be stalled upon disengagement of the clutch, and the driveability of the engine can be spoiled at rapid acceleration of the engine, when the engine returns into a normal operating condition after termination of the fuel cut. Particularly, if the fuel cut effecting intake pipe pressure is too low, unburned fuel can be emitted in large quantities together with exhaust gases, which reacts with a three-way catalyst arranged in the exhaust pipe of the engine to cause burning of the catalyst, resulting in emission of detrimental exhaust gases.

Further, if the fuel cut is carried out when the engine temperature is low, the engine can also be stalled upon disengagement of the clutch immediately after termination of the fuel cut, since sliding component parts of the engine have large frictional resistance in such a cold condition.

OBJECTS AND SUMMARY OF THE INVENTION

It is an object of the invention to provide a deceleration fuel cut device for an internal combustion engine, which is adapted to accurately determine a fuel cut effecting condition from the intake pipe pressure, to thereby prevent deterioration of the driveability of the engine at fuel cut operation.

It is a further object of the invention to provide a deceleration fuel cut device for an internal combustion engine, which is arranged such that the intake pipe pressure at which the fuel cut is to be effected is variable as a function of the engine rotational speed, to thereby improve the driveability of the engine as well as the emission characteristics, and also prevent engine stall which would take place immediately after termination of the fuel cut.

It is another object of the invention to provide a deceleration fuel cut device for an internal combustion engine, which is arranged such that the engine rotational speed at which the fuel cut is to be effected is variable as a function of the engine temperature, to thereby prevent engine stall which would take place immediately after termination of the fuel cut.

It is a further object of the invention to provide a deceleration fuel cut device for an internal combustion engine, in which the engine rotational speed and/or the intake pipe pressure at which the fuel cut is to be effected is set at different predetermined values between the time of initiation of the fuel cut and the time of termination of same, to thereby ensure highly stable engine operation.

The present invention provides a deceleration fuel cut device for combination with a fuel supply control system provided with a fuel injection device for injecting fuel into an internal combustion engine and operable to electronically control the fuel injection device for control of the amount of fuel being supplied to the engine. The deceleration fuel cut device comprises engine operating condition detecting means including a first sensor for detecting the rotational speed of the engine and a second sensor for detecting the pressure in the intake pipe; fuel cut condition determining means adapted to determine that the engine is in a condition requiring fuel cut when the engine rotational speed detected by the first sensor has a value higher than a predetermined value and simultaneously the intake pipe pressure detected by the second sensor has a value lower than a predetermined value; and fuel cut means responsive to the result of the determination of the fuel cut condition determining means for causing the fuel injection device to cut off the supply of fuel to the engine. Preferably, the engine operating condition detecting means further includes a third sensor for detecting the engine temperature, and the fuel cut condition determining means is arranged such that the above predetermined engine rotational speed value is set to lower values as the engine temperature detected by the third sensor increases. Also preferably, the fuel cut condition determining means is arranged such that the above predetermined intake pipe pressure value is set to higher values as the engine rotational speed detected by the first sensor increases. Advantageously, the predetermined engine rotational speed value and/or the predetermined intake pipe pressure value is set at different values between the time of initiation of the fuel cut and the time of termination of same, to impart a hysteresis characteristic to the fuel cut operation.

The above and other objects, features and advantages of the invention will be more apparent from the ensuing detailed description taken in connection with the accompanying drawings in which:

DETAILED DESCRIPTION

The present invention will now be described in detail with reference to the drawings.

Figure 1:
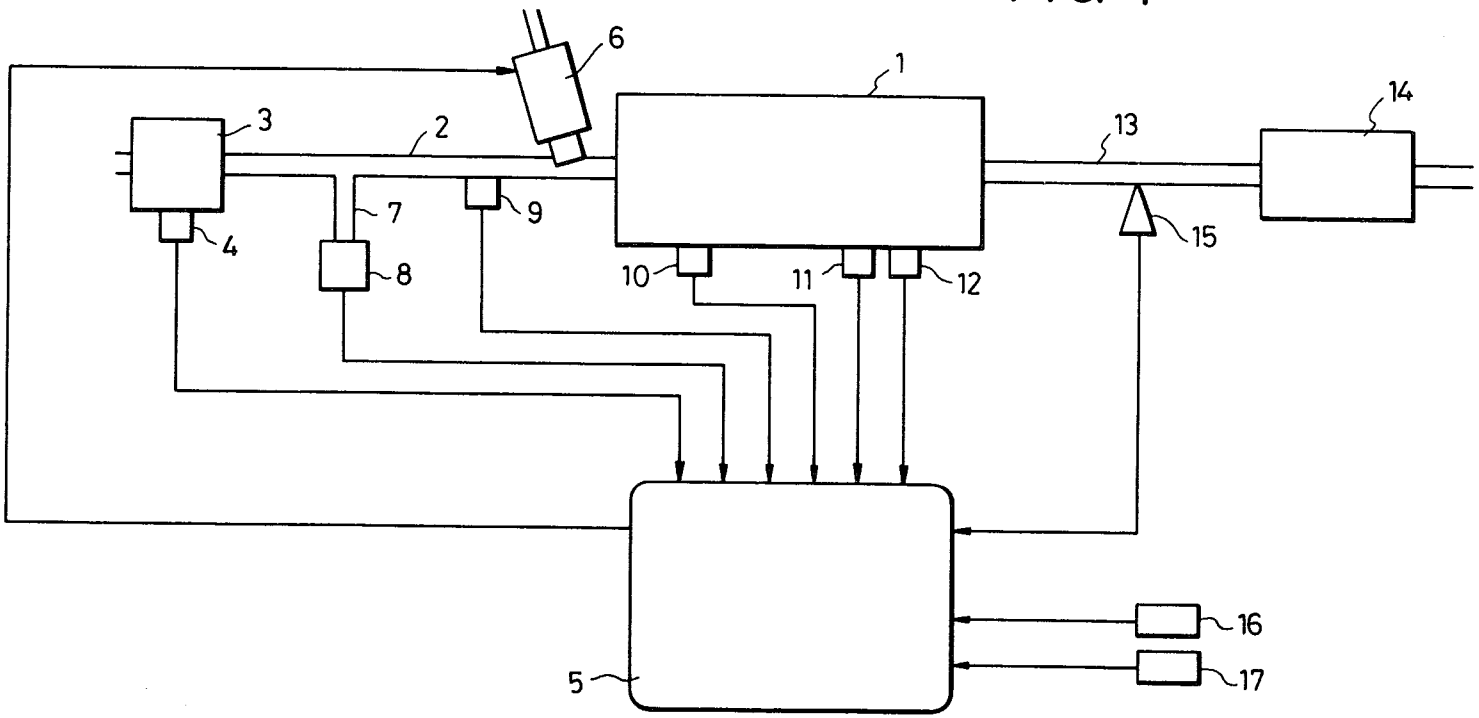
FIG. 1 is a block diagram illustrating the whole arrangement of a fuel supply control system provided with a deceleration fuel cut device according to the present invention.

Referring first to FIG. 1, there is illustrated the whole arrangement of a fuel supply control system for internal combustion engines, to which the present invention is applicable. Regerence numeral 1 designates an internal combustion engine which may be a four-cylinder type, for instance. This engine 1 has main combustion chambers which may be four in number and sub combustion chambers communicating with the main combustion chambers, none of which is shown. An intake pipe 2 is connected to the engine 1, which comprises a main intake pipe communicating with each main combustion chamber, and a sub intake pipe with each sub combustion chamber, respectively, neither of which is shown. Arranged across the intake pipe 2 is a throttle body 3 which accommodates a main throttle valve and a sub throttle valve mounted in the main intake pipe and the sub intake pipe, respectively, for synchronous operation. Neither of the two throttle valves is shown. A throttle valve opening sensor 4 is connected to the main throttle valve for detecting its valve opening and converting same into an electrical signal which is supplied to an electronic control unit (hereinafter called "ECU") 5.

A fuel injection device 6 is arranged in the intake pipe 2 at a location between the engine 1 and the throttle body 3, which comprises main injectors and a subinjector, none of which is shown. The main injectors correspond in number to the engine cylinders and are each arranged in the main intake pipe at a location slightly upstream of an intake valve, not shown, of a corresponding engine cylinder, while the subinjector, which is single in number, is arranged in the sub intake pipe at a location slightly downstream of the sub throttle valve, for supplying fuel to all the engine cylinders. The main injectors and the subinjector are electrically connected to the ECU 5 in a manner having their valve opening periods or fuel injection quantities controlled by signals supplied from the ECU 5.

On the other hand, an absolute pressure sensor 8 communicates through a conduit 7 with the interior of the main intake pipe of the throttle body 3 at a location immediately downstream of the main throttle valve. The absolute pressure sensor 8 is adapted to detect absolute pressure in the intake pipe 2 and applies an electrical signal indicative of detected absolute pressure to the ECU 5. An intakeair temperature sensor 9 is arranged in the intake pipe 2 at a location downstream of the absolute pressure sensor 8 and also electrically connected to the ECU 5 for supplying thereto an electrical signal indicative of detected intakeair temperature.

An engine temperature sensor 10, which may be formed of a thermistor or the like, is mounted on the main body of the engine 1 in a manner embedded in the peripheral wall of an engine cylinder having its interior filled with cooling water, an electrical output signal of which is supplied to the ECU 5.

An engine rpm sensor (hereinafter called "Ne sensor") 11 and a cylinder-discriminating sensor 12 are arranged in facing relation to a camshaft, not shown, of the engine 1 or a crankshaft of same, not shown. The former 11 is adapted to generate one pulse at a particular crank angle each time the engine crankshaft rotates through 180 degrees, i.e., upon generation of each pulse of the top-dead-center position (TDC) signal, while the latter is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the main body of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a detected concentration value to the ECU 5.

Further connected to the ECU 5 are a sensor 16 for detecting atomospheric pressure and a starter switch 17 for actuating the starter, not shown, of the engine 1, respectively, for supplying an electrical signal indicative of detected atmospheric pressure and an electrical signal indicative of its own on and off positions to the ECU 5.

Next, the fuel quantity control operation of the air/fuel ratio feedback control system of the invention arranged as above will now be described in detail with reference to FIG. 1 referred to hereinabove and FIGS. 2 through 13.

Figure 2:
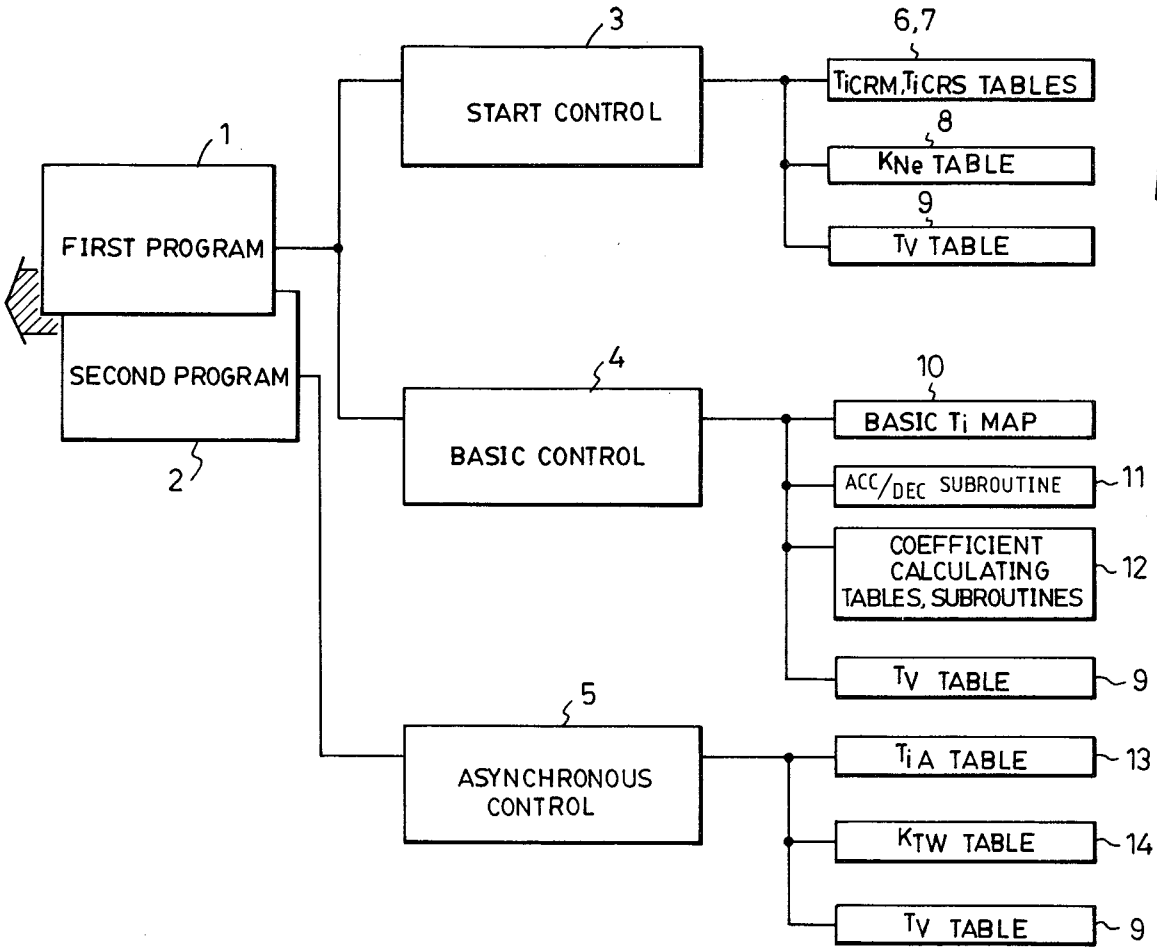
FIG. 2 is a block diagram illustrating a whole program for control of the valve-opening periods TOUTM and TOUTS of the main injectors and the subinjector, which is incorporated in the electronic control unit (ECU) in FIG. 1.

Referring first to FIG. 2, there is illustrated a block diagram showing the whole program for air/fuel ratio control, i.e. control of valve opening periods TOUTM, TOUTS of the main injectors and the subinjector, which is executed by the ECU 5. The program comprises a first program 1 and a second program 2. The first program 1 is used for fuel quantity control in synchronism with the TDC signal, hereinafter merely called "synchronous control" unless otherwise specified, and comprises a start control subroutine 3 and a basic control subroutine 4, while the second program 2 comprises an asynchronous control subroutine 5 which is carried out in asynchronism with or independently of the TDC signal.

In the start control subroutine 3, the valve opening periods TOUTM and TOUTS are determined by the following basic equations:

$$TOUTM = TiCRM \times KNe + (TV + \Delta TV) \quad (1)$$

$$TOUTS = TiCRS \times KNe + TV \quad (2)$$

where TiCRM, TiCRS represent basic values of the valve opening periods for the main injectors and the subinjector, respectively, which are determined from a TiCRM table 6 and a TiCRS table 7, respectively, KNe represents a correction coefficient applicable at the start of the engine, which is variable as a function of engine rpm Ne and determined from a KNe table 8, and TV represents a constant for increasing and decreasing the valve opening period in response to changes in the output voltage of the battery, which is determined from a TV table 9. $\Delta TV$ is added to TV applicable to the main injectors as distinct from TV applicable to the subinjector, because the main injectors are structurally different from the subinjector and therefore have different operating characteristics.

The basic equations for determining the values of TOUTM and TOUTS applicable to the basic control subroutine 4 are as follows:

$$TOUTM = (TiM - TDEC) \times (KTA \times KTW \times KAFC \times KPA \times KAST \times KWOT \times KO_2 \times KLS) + TACC \times (KTA \times KTWT \times KAFC \times KPA \times KAST) + (TV + \Delta TV) \quad (3)$$

$$TOUTS = (TiS - TDEC) \times (KTA \times KTW \times KAST \times KPA) + TV \quad (4)$$

where TiM, Tis represent basic values of the valve opening periods for the main injectors and the subinjector, respectively, and are determined from a basic Ti map 10, and TDEC, TACC represent constants applicable, respectively, at engine decceleration and at engine acceleration and are determined by acceleration and decceleration subroutines 11. The coefficients KTA, KTW, etc. are determined by their respective tables and/or subroutines 12. KTA is an intake air temperature-dependent correction coefficient and is determined from a table as a function of actual intake air temperature, KTW a fuel increasing coefficient which is determined from a table as a function of actual engine cooling water temperature TW, KAFC a fuel increasing coefficient applicable after fuel cut operation and determined by a subroutine, KPA an atmospheric pressure-dependent correction coefficient determined from a table as a function of actual atmospheric pressure, and KAST a fuel increasing coefficient applicable after the start of the engine and determined by a subroutine. KWOT is a coefficient for enriching the air/fuel mixture, which is applicable at wide-open-throttle and has a constant value, $KO_2$ an "$O_2$ feedback control" correction coefficient determined by a subroutine as a function of actual oxygen concentration in the exhaust gases, and KLS a mixture-leaning coefficient applicable at "lean stoich." operation and having a constant value. The term "stoich." is an abbreviation of a word "stoichiometric" and means a stoichiometric or theoretical air/fuel ratio of the mixture. TACC is a fuel increasing constant applicable at engine acceleration and determined by a subroutine and from a table.

On the other hand, the valve opening period TMA for the main injectors which is applicable in asynchronism with the TDC signal is determined by the following equation:

$$TMA = TiA \times KTWT \times KAST + (TV + \Delta TV) \quad (5)$$

where TiA represents a TDC signal-asynchronous fuel increasing basic value applicable at engine acceleration and in asynchronism with the TDC signal. This TiA value is determined from a TiA table 13. KTWT is defined as a fuel increasing coefficient applicable at and after TDC signal-synchronous acceleration control as well as at TDC signal-asynchronous acceleration control, and is calculated from a value of the aforementioned water temperature-dependent fuel increasing coefficient KTW obtained from the table 14.

Figure 3:
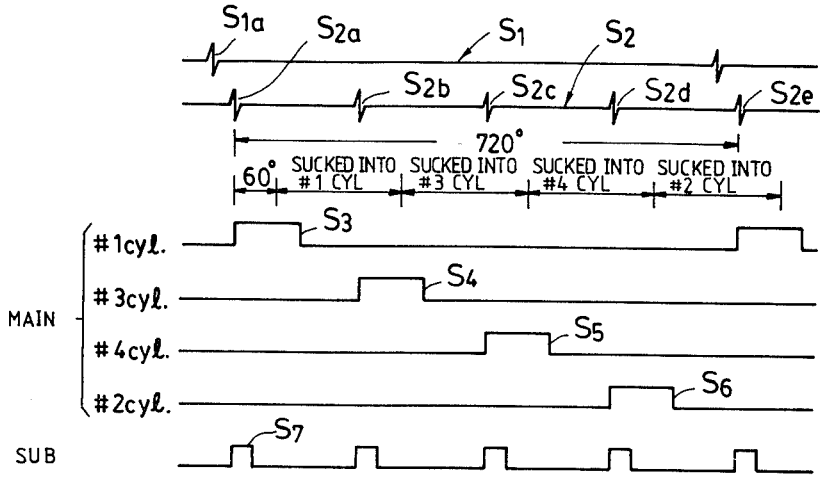
FIG. 3 is a timing chart showing the relationship between a cylinder-discriminating signal and a TDC signal inputted to the ECU, and drive signals for the main injectors and the subinjector, outputted from the ECU.

FIG. 3 is a timing chart showing the relationship between the cylinder-discriminating signal and the TDC signal, both inputted to the ECU 5, and the driving signals outputted from the ECU 5 for driving the main injectors and the subinjector. The cylinder-discriminating signal $S_1$ is inputted to the ECU 5 in the form of a pulse $S_1a$ each time the engine crankshaft rotates through 720 degrees. Pulses $S_2a$–$S_2e$ forming the TDC signal $S_2$ are each inputted to the ECU 5 each time the engine crankshaft rotates through 180 degrees. The relationship in timing between the two signals $S_1$, $S_2$ determines the output timing of driving signals $S_3$–$S_6$ for driving the main injectors of the four engine cylinders. More specifically, the driving signal $S_3$ is outputted for driving the main injector of the first engine cylinder, concurrently with the first TDC signal pulse $S_2a$, the driving signal $S_4$ for the third engine cylinder concurrently with the second TDC signal pulse $S_2b$, the driving signal $S_5$ for the fourth cylinder concurrently with the third pulse $S_2c$, and the driving signal $S_6$ for the second cylinder concurrently with the fourth pulse $S_2d$, respectively. The subinjector driving signal $S_7$ is generated in the form of a pulse upon application of each pulse of the TDC signal to the ECU 5, that is, each time the crankshaft rotates through 180 degrees. It is so arranged that the pulses $S_2a$, $S_2b$, etc. of the TDC signal are each generated earlier by 60 degrees than the time when the piston in an associated engine cylinder reaches its top dead center, so as to compensate for arithmetic operation lag in the ECU 5, and a time lag between the formation of a mixture and the suction of the mixture into the engine cylinder, which depends upon the opening action of the intake pipe before the piston reaches its top dead center and the operation of the associated injector.

Figure 4:
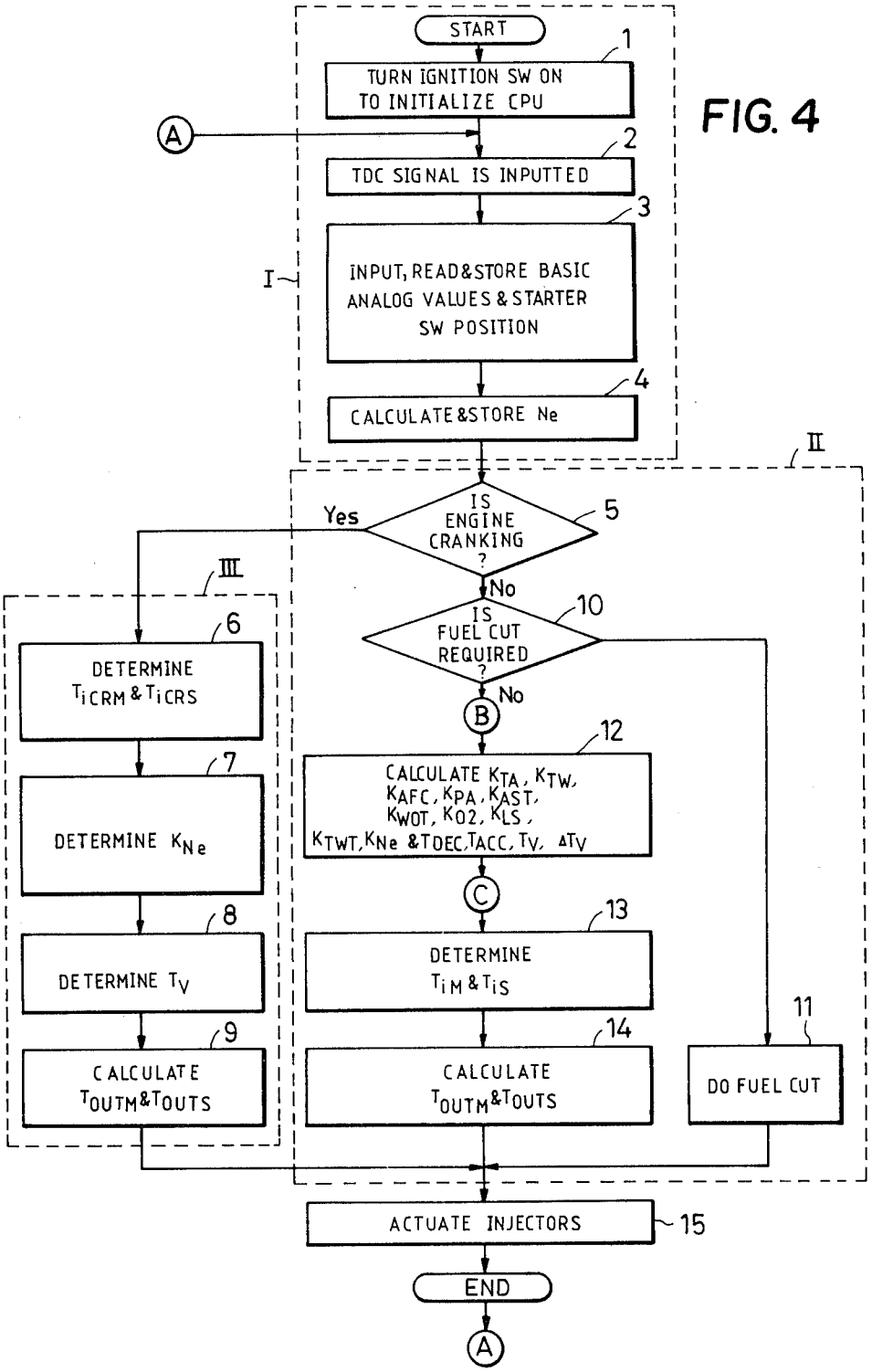
FIG. 4 is a flow chart showing a main program for control of the fuel supply.

Referring next to FIG. 4, there is shown a flow chart of the aforementioned first program 1 for control of the valve opening period in synchronism with the TDC signal in the ECU 5. The whole program comprises an input signal processing block I, a basic control block II and a start control block III. First in the input signal processing block I, when the ignition switch of the engine is turned on, CPU in the ECU 5 is initialized at the step 1 and the TDC signal is inputted to the ECU 5 as the engine starts at the step 2. Then, all basic analog values are inputted to the ECU 5, which include detected values of atmospheric pressure PA, absolute pressure PB, engine cooling water temperature TW, atmospheric air temperature TA, throttle valve opening $\theta$th, battery voltage V, output voltage value V of the $O_2$ sensor and on-off state of the starter switch 17, some necessary ones of which are then stored therein (step 3). Further, the period between a pulse of the TDC signal and the next pulse of same is counted to calculate actual engine rpm Ne on the basis of the counted value, and the calculated value is stored in the ECU 5 (step 4). The program then proceeds to the basic control block II. In this block, a determination is made, using the calculated Ne value, as to whether or not the engine rpm is smaller than the cranking rpm (starting rpm) at the step 5. If the answer is affirmative, the program proceeds to the start control subroutine III. In this block, values of TiCRM and TiCRS are selected from a TiCRM table and a TiCRS table, respectively, on the basis of the detected value of engine cooling water temperature TW (step 6). Also, the value of Ne-dependent correction coefficient KNe is determined by using the KNe table (step 7). Further, the value of battery voltage-dependent correction constant TV is determined by using the TV table (step 8). These determined values are applied to the aforementioned equations (1), (2) to calculate the values of TOUTM, TOUTS (step 9).

If the answer to the question of the above step 5 is no, it is determined whether or not the engine is in a condition for carrying out fuel cut, at the step 10. If the answer is yes, the values of TOUTM and TOUTS are both set to zero, at the step 11.

On the other hand, if the answer to the question of the step 10 is negative, calculations are carried out of values of correction coefficients KTA, KTW, KAFC, KPA, KAST, KWOT, $KO_2$, KLS, KTWT, etc. and values of correction constants TDEC, TACC, TV, and $\Delta$TV, by means of the respective calculation subroutines and tables, at the step 12.

Then, basic valve opening period values TiM and TiS are selected from respective maps of the TiM value and the TiS value, which correspond to data of actual engine rpm Ne and actual absolute pressure PB and/or like parameters, at the step 13.

Then, calculations are carried out of the values TOUTM, TOUTS on the basis of the values of correction coefficients and correction constants selected at the steps 12 and 13, as described above, using the aforementioned equations (3), (4) (the step 14). The main injectors and the subinjector are actuated with valve opening periods corresponding to the values of TOUTM, TOUTS obtained by the aforementioned steps 9, 11 and 14 (the step 15).

As previously stated, in addition to the above-discribed control of the valve opening periods of the main injectors and the subinjector in synchronism with the TDC signal, asynchronous control of the valve opening periods of the main injectors is carried out in a manner asynchronous with the TDC signal but synchronous with a certain pulse signal having a constant pulse repetition period, detailed description of which is omitted here.

Figure 5:
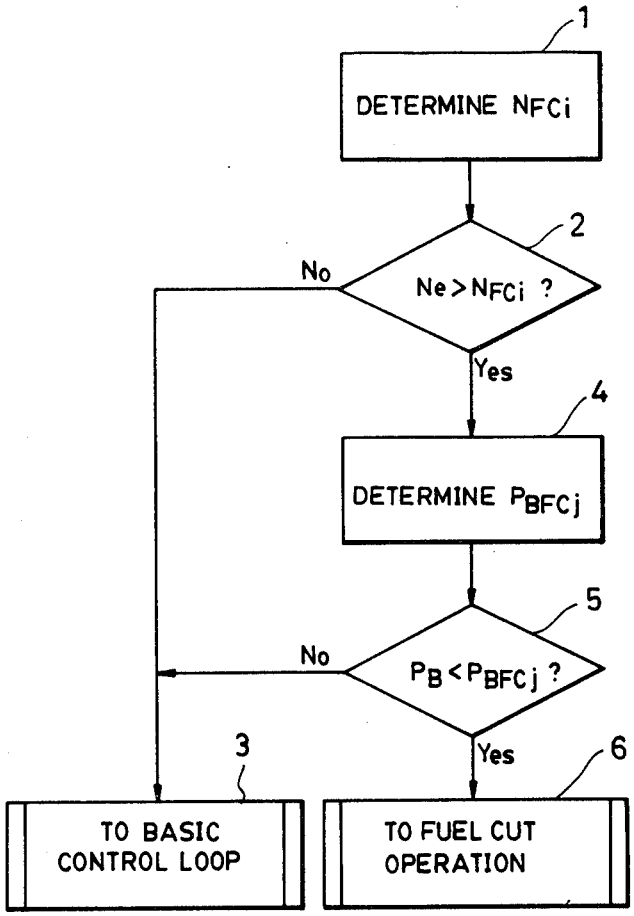
FIG. 5 is a flow chart showing a subroutine for determining the fuel cut condition of the engine.

Referring to FIG. 5, there is shown a flow chart of the fuel cut determining subroutine which is executed when it is determined at the step 5 in FIG. 4 that the engine rpm exceeds the cranking rpm.

First, at the step 1, the engine cooling water temperature TW is used to determine the value of fuel cut determining rpm NFCi. When the engine water temperature is low, sliding parts of the engine have large frictional resistance, making the engine operation unstable. Therefore, unless the fuel cut determining rpm NFCi for fuel cut operation at low temperatures is set to a value higher than that for same after completion of warming-up of the engine, there is a high risk that the engine is stalled when the clutch is disengaged immediately after the fuel cut operation. Therefore, according to the invention, when the engine water temperature is low, the fuel cut determining rpm NFCi is set to a relatively high value, while at a high engine water temperature, the rpm NFCi is set to a relatively low value, so as to prevent engine stall, deterioration of the engine driveability and the increase of detrimental exhaust gases, and also keep the fuel consumption to a minimum.

Figure 6:
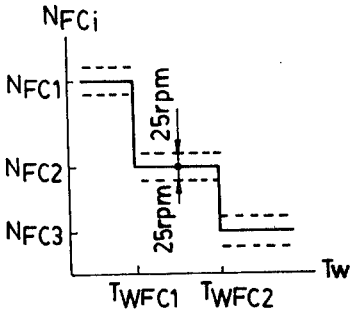
FIG. 6 is a view showing a table of the relationship between engine cooling water temperature TW and fuel cut determining rpm NFCi.
Figure 7:
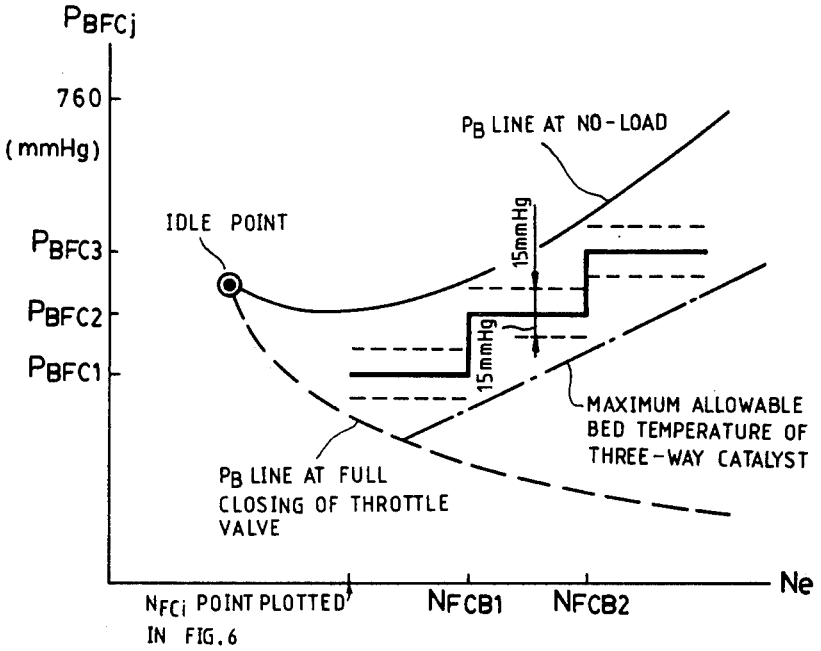
FIG. 7 is a view showing a table of the relationship between engine rpm Ne and fuel cut determining intake pipe absolute pressure PBFCj.

FIG. 6 shows an NFCi table plotting, as an example, the relationship between the engine cooling water TW and the fuel cut determining rpm NFCi. According to this table, two predetermined water temperature values TWFC1 (20° C.) and TWFC2 (50° C.) are provided, while predetermined fuel cut determining rpm values NFC1 (2000 rpm), NFC2 (1600 rpm) and NFC3 (1200 rpm) are provided in relation to the above predetermined water temperature values. The above predetermined fuel cut determining rpm values are each provided with a hysteresis margin of $\pm$25 rpm. That is, as to the value NFC2, to interrupt the fuel cut operation, the actual engine rpm has to be lower than 1575 rpm, while to resume the same operation it should be higher than 1625 rpm. By thus providing a hysteresis margin of $\pm$25 rpm at the transition between the fuel cut operating region and an adjacent non-fuel cut operating region, fine fluctuations in the engine rpm Ne can be substantially absorbed or ignored to ensure stable engine operation. Reverting then to FIG. 5, it is determined whether or not the engine rpm Ne is higher than the above fuel cut determining rpm NFCi at the step 2. If the former is found to be lower than the latter, the program proceeds to the basic control loop, at the step 3, while if the former is found to be higher than the latter, the value of fuel cut determining absolute pressure PBFCj is determined in dependence upon the actual engine rpm Ne at the step 4. As shown in FIG. 7, the fuel cut determining absolute pressure PBFCj is set at values falling within a range between an absolute pressure PB line assumed with no load on the engine when the accelerator pedal is stepped on with the clutch disengaged or with the transmission in its neutral position, and an absolute pressure PB line assumed with the throttle valve in its full closing position. Also, the fuel cut determining absolute pressure PBFCj has to be set so as to exceed the absolute pressure PB line corresponding to the maximum allowable bed temperature of the three-way catalyst below which the temperature of the three-way catalyst rises to an abnormal extent. If the above fuel cut determining absolute pressure PBFCj is set along a line intersecting with the absolute pressure PB line at no engine load, fuel cut can take place during no-load operation of the engine so that the engine torque increases and decreases repeatedly, to cause hunting in the engine speed, resulting in deterioration of the driveability. Also, with an increase in the engine rpm, the amount of exhaust gases flowing into the three-way catalyst per unit time increases even when the absolute pressure PB remains unchanged. Thus, the amount of detrimental ingredients, particularly unburned fuel for reaction in the catalyst per unit time increases so that the temperature of three-way catalyst can reach the burning point sooner. Therefore, it is necessary to set the fuel cut determining absolute pressure PBFCj so as to increase with the increase of the engine rpm Ne in order to reduce the amount of exhaust gas ingredients for reaction in the catalyst per unit time. The above increasing rate of the fuel cut determining absolute pressure PBFCj depends upon the cooling degree of the catalyst. Further, it is desirable to set the fuel cut determining absolute pressure PBFCj at such a low value as can keep the fuel consumption to a minimum but not spoil the driveability.

In view of the above, according to the invention, as shown in FIG. 7, by way of example, two predetermined engine rpm values NFCB1 (1500 rpm) and NFCB2 (3000 rpm) are provided, while the fuel cut determining absolute pressure PBFCj is set at predetermined values PBFC1 (180 mmHg), PBFC2 (200 mmHg) and PBFC3 (220 mmHg). Further, according to the invention, as hereinlater described in detail, the predetermined fuel cut determining absolute pressure values PBFC1, PBFC2 and PBFC3 are each provided with a hysteresis margin, e.g. ±15 mmHg. Reverting now to FIG. 5, it is determined whether or not the actual absolute pressure PB is lower than the fuel cut determining absolute pressure PBFCj, at the step 5. If the former is found to be higher than the latter, the program proceeds to the aforementioned basic control loop, while if the former is found to be lower than the latter, the fuel cut operation is effected (the step 6).

Figure 8:
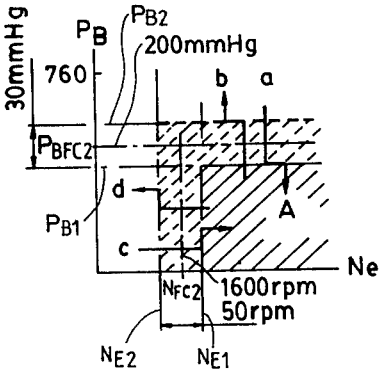
FIG. 8 is a graph showing a fuel cut operating region determined by engine rpm Ne and intake pressure PB.

FIG. 8 shows a fuel cut operating region A determined by engine rpm Ne and intake pipe absolute pressure PB. Taking the fuel cut determining rpm NFC2 and the fuel cut determining absolute pressure PBFC2 for instance, the arrow a designates a case where the fuel cut operation is effected as the absolute pressure PB drops. In this case, the fuel cut determining absolute pressure PBFCj is set at 185 mmHg. Inversely, when the fuel cut operation is interrupted, the fuel cut determining absolute pressure PBFCj is set at 215 mmHg as indicated by the arrow b. The arrow c indicates a case where the fuel cut operation is carried out due to an increase in the engine rpm Ne. In this case, the fuel cut determining rpm NFCi assumes a value of 1625 rpm. Inversely, in interrupting the fuel cut operation, the fuel cut determining rpm NFCi has a value of 1575 rpm as indicated by the arrow d. By providing the fuel cut determining rpm NFCi and the fuel cut determining absolute pressure PBFCj with hysteresis margins so that they have different values between the time of entrance into the fuel cut operation and the time of interruption of same as mentioned above, any fine fluctuations in the actual engine rpm Ne and the actual absolute pressure PB can be cancelled to ensure stable operation of the engine.

Figure 10:
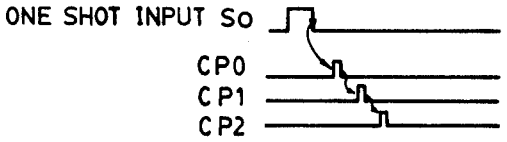
FIG. 10 is a timing chart showing the relationship between a signal So inputted to the sequential clock generator in FIG. 9 and a clock signal outputted therefrom.
Figure 9:
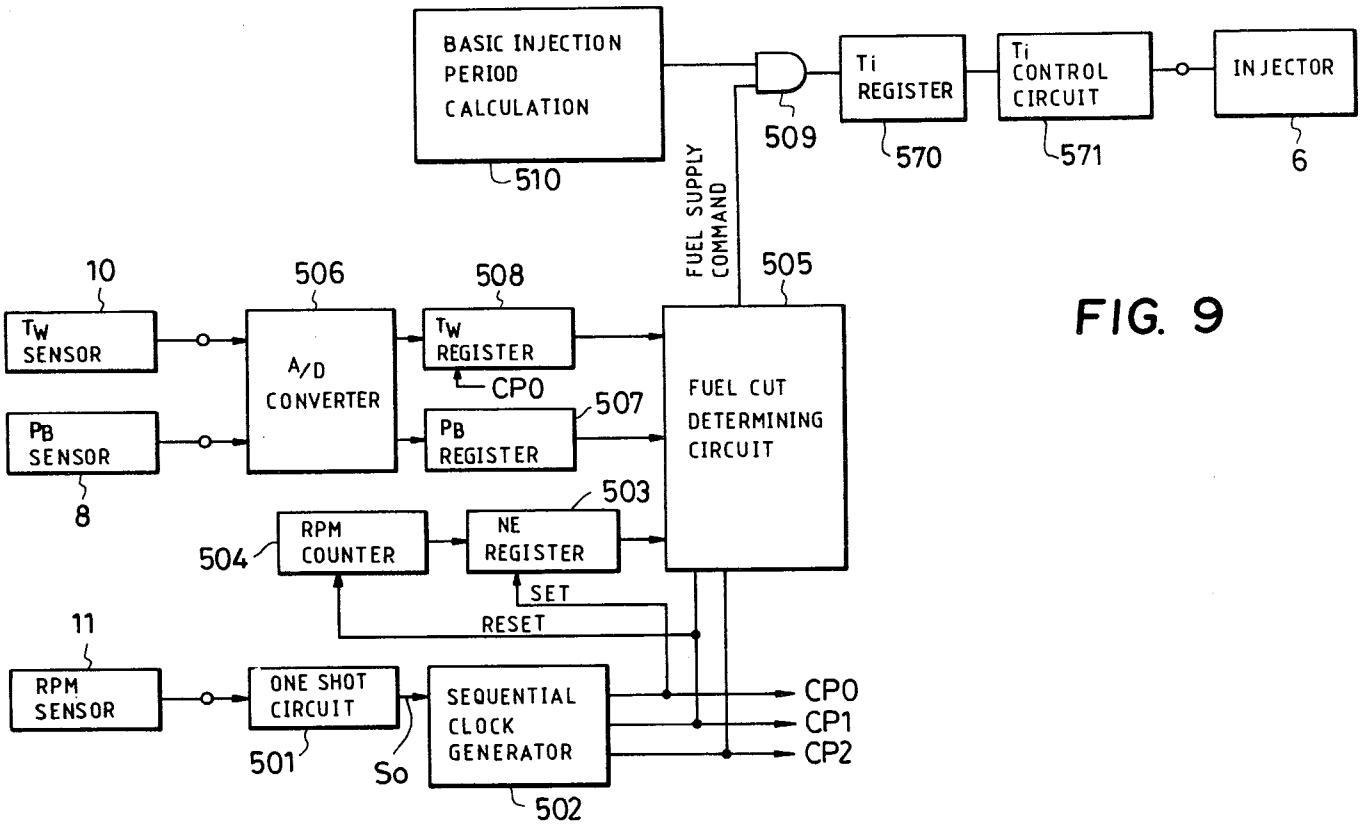
FIG. 9 is a block diagram illustrating the internal arrangement of the ECU in FIG. 1, inclusive of a fuel cut determining circuit.

FIG. 9 is a block diagram illustrating part of the internal arrangement of the ECU 5 in FIG. 1, showing in particular detail a section for determining fulfillment of the fuel cut condition to control the fuel injection device for supply of fuel to the engine. The TDC signal picked up by the engine rpm sensor 11 in FIG. 1 is applied to a one-shot circuit 501 forming a waveform shaper in cooperation with a sequential clock generator 502 arranged postadjacent thereto. The one-shot circuit 501 generates an output signal So upon application of each TDC signal pulse thereto, which signal triggers the sequential clock generator 502 to generate clock pulses CP0 - 2 in a sequential manner. FIG. 10 shows a timing chart of clock pulses generated by the sequential clock generator 502. The clock generator 502 sequentially generates pulses CP0 - 2 each time it is supplied with the signal So from the one-shot circuit 501. The clock pulse CP0 is supplied to an engine rpm (NE) register 503 to cause same to store an immediately preceding count in an engine rpm counter 504 which counts reference clock pulses. The above clock pulse CP0 is also supplied to an engine water temperature (TW) register 508, hereinlater referred to. The clock pulse CP1 is applied to the engine rpm counter 504 to reset same to zero. Therefore, the engine rpm Ne is measured in the form of a number of reference clock pulses counted between two adjacent pulses of the TDC signal, and the measured pulse number NE is stored in the above engine rpm (NE) register 503. Further, the above clock pulse CP1 and its immediately following clock pulse CP2 are supplied to a fuel cut determining circuit 505, hereinlater referred to.

In a manner parallel with the above operation, output signals of the absolute pressure (PB) sensor 8 and the engine water temperature (TW) sensor 10 are applied to an A/D converter 506 to be converted thereby into respective digital signals which are then applied to an absolute pressure (PB) register 507 and an engine water temperature (TW) register 508, respectively. The values stored in the above registers are supplied to the fuel cut determining circuit 505.

The fuel cut determining circuit 505 is responsive to the values inputted from the above registers 503, 507 and 508 to determine whether or not the fuel cut condition is fulfilled. When it determines fulfillment of the fuel cut condition, the circuit 505 generates a binary output of 1 and applies it to one input terminal of an AND circuit 509. The AND circuit 509 has its other input terminal supplied with data of the basic value Ti indicative of required valve opening periods of the main injectors and the subinjector, from a basic fuel injection period control circuit 510. The circuit 510, which is connected to the above registers 503, 507 and 508 and other necessary registers, though their connections are not illustrated, performs an arithmetic operation by using the coefficients and constants, to determine a basic fuel injection period Ti to supply corresponding driving outputs to the main injectors and the subinjector.

On the other hand, when it is determined by the fuel cut determining circuit 505 that the fuel cut condition has been fulfilled, the circuit 505 generates a binary output of 0 and applies it to the AND circuit 509 to close same to a Ti value register 562 and a Ti value control circuit 563 to render the valve opening periods of the main injectors and the subinjector both zero, that is, carry out the fuel cut.

Figure 11:
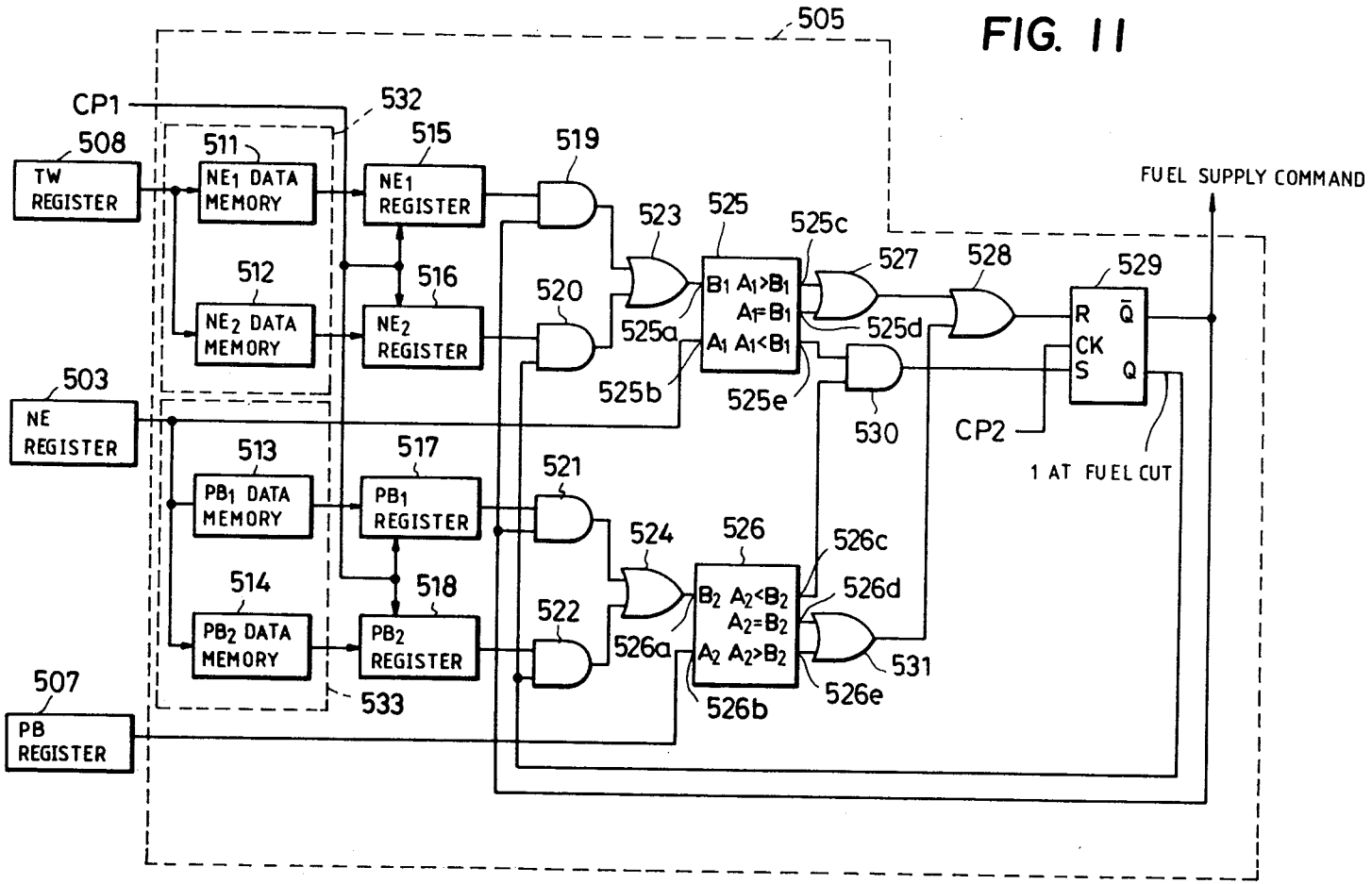
FIG. 11 is a circuit diagram illustrating the internal arrangement of the fuel cut determining circuit in FIG. 9.

FIG. 11 illustrates details of the fuel cut determining circuit 505 in FIG. 9. The circuit 505 includes data memories 511 and 512 which store, respectively, higher predetermined values NE1 and lower predetermined values NE2 provided for the predetermined fuel cut determining engine rpm values NFC1–3 shown in FIG. 6 to impart a hysteresis characteristic to the fuel cut operation between the time of initiation of the fuel cut and the time of termination of same, and also data memories 513 and 514 storing, respectively, like predetermined values PB1 and PB2 for the predetermined fuel cut determining absolute pressure values PBFC1–3 shown in FIG. 7. The engine water temperature (TW) register 508 in FIG. 9 is connected to the NE1 data memory 511 and the NE2 data memory 512, and the engine rpm (NE) register 503 in FIG. 9 to the PB1 data memory 513 and the PB2 data memory 514, respectively. The values stored in the engine water temperature (TW) register 508 and the engine rpm (NE) register 503, which are indicative of actual engine water temperature and actual engine rpm, respectively, are applied to the data memories 511–514 where corresponding values NE1, NE2, PB1 and PB2 are selected. The selected values are loaded into respective ones of an NE1 value register 515, an NE2 value register 516, a PB1 value register 517 and a PB2 value register 518, upon application of a clock pulse CP1 generated from the sequential clock generator 502 in FIG. 9 thereto. The outputs of the NE1 value register 515 and the NE2 value register 516 are connected to an OR circuit 523 by way of respective AND circuits 519 and 520, and the outputs of the PB1 value register 517 and the PB2 value register 518 to an OR circuit 524 by way of respective AND circuits 521 and 522, respectively. The OR circuits 523 and 524 are connected to input terminals 525*a* and 526*a* of respective comparators 525 and 526 which have their other input terminals 525*b* and 526*b* connected to respective ones of the NE value register 503 and the PB value register 507, both appearing in FIG. 9. The comparator 525 has output terminals 525*c* and 525*d* connected to the reset pulse-input terminal R of an RS flip flop 529 by way of OR circuits 527 and 528, and another output terminal 525*e* to the set pulse-input terminal S of same by way of an AND circuit 530, respectively. On the other hand, the comparator 526 has an output terminal 526*c* connected to the set pulse-input terminal S of the above flip flop 529 by way of the above AND circuit 530, and other output terminals 526*d* and 526*e* to the reset pulse-input terminal R of same by way of OR circuits 531 and 528, respectively.

The flip flop 529 has its Q-output terminal connected to the inputs of the aforementioned AND circuits 520 and 522, and its $\overline{Q}$-output terminal to the inputs of the aforementioned AND circuits 519 and 521 and also to the input of the AND circuit 509 appearing in FIG. 9, respectively. The flip flop 529 has a clock input terminal CK arranged to be supplied with a clock pulse CP2 from the sequential clock generator 502 in FIG. 9.

The operation of the arrangement of FIG. 11 described above will now be explained.

As described later, the flip flop 529 is arranged to generate an output of 1 at its $\overline{Q}$-output terminal, when the fuel cut condition is not fulfilled, that is, when the supply of fuel to the engine is normally carried out. The above output of 1 is applied to one input terminal of the AND circuit 519 which has its other input terminal supplied with a value stored in the NE1 value register 515 which is set by a clock pulse CP1. Thus, the AND circuit 519 generates a signal indicative of a fuel cut determining rpm NE1 applicable at initiation of the fuel cut operation. In a manner similar to the above, the AND circuit 521, which is connected to the $\overline{Q}$-output terminal of the flip flop 529, generates a signal indicative of a fuel cut determining absolute pressure PB1 applicable at initiation of the fuel cut operation. The above output signals of the AND circuits 519 and 521 are applied to the input terminals 525*a* and 526*a* of their respective comparators 525 and 526, as inputs $B_1$ and $B_2$. The comparators 525 and 526 are supplied at their other input terminals 525*b* and 526*b*, respectively, with values as inputs $A_1$ and $A_2$ from the engine rpm (NE) register 503 and the absolute pressure (PB) register 507, both appearing in FIG. 9, which are indicative of actual engine rpm Ne and actual absolute pressure PB, respectively. The comparator 525 compares the input value $A_1$ with the input value $B_1$, and the comparator 526 the input value $A_2$ with the input value $B_2$, respectively. First, the comparator 525 generates an output of 1 through its output terminals 525*c* and 525*d*, respectively, when the value of the detected NE signal $A_1$ is larger than that of the stored NE1 signal $B_1$ and when the former is equal to the latter (that is, the relationship of actual engine rpm $\leqq$ a predetermined fuel cut determining rpm stands, because the value of the NE signal $A_1$ is equivalent to a reciprocal of the engine rpm). The above output of 1 of the comparator 525 is applied to one input terminal of the OR circuit 528 through the OR circuit 527. The comparator 526 generates an output of 1 through its output terminals 526*d* and 526*e*, respectively, when the value of the detected absolute pressure (PB) signal $A_2$ is larger than that of the stored PB1 signal $B_2$ and when the former is equal to the latter, and applied it to the other input terminal of the OR circuit 528 through the OR circuit 531. When supplied with either of the above two output signals of 1, the OR circuit 528 applies an output of 1 to the reset pulse-input terminal R of the flip flop 529. Then, the flip flop 529 is resetted by a clock pulse CP2 generated from the sequential clock generator 502 in FIG. 9 to generate an output of 1 through its $\overline{Q}$-output terminal. This output of 1 is applied to the AND circuit 509 as a fuel supply command, to cause usual control of the valve opening periods of the injectors.

When the fuel cut condition is fulfilled, that is, the relationship of $A<B$ stands in the comparator 525, and that of $A_2<B_2$ stands in the comparator 526, the comparators 525 and 526 both generate outputs of 1 and apply them to the AND circuit 530 which in turn applies an output of 1 to the set pulse-input terminal S of the flip flop 529. Upon application of a clock pulse CP2 to the flip flop 529, it generates an output of 1 at its Q-output terminal and simultaneously an output of 0 at its $\overline{Q}$-output terminal so that the AND circuit 509 in FIG. 9 generates an output of 0, causing initiation of the fuel cut operation where the supply of fuel to the engine is interrupted.

Figure 12:
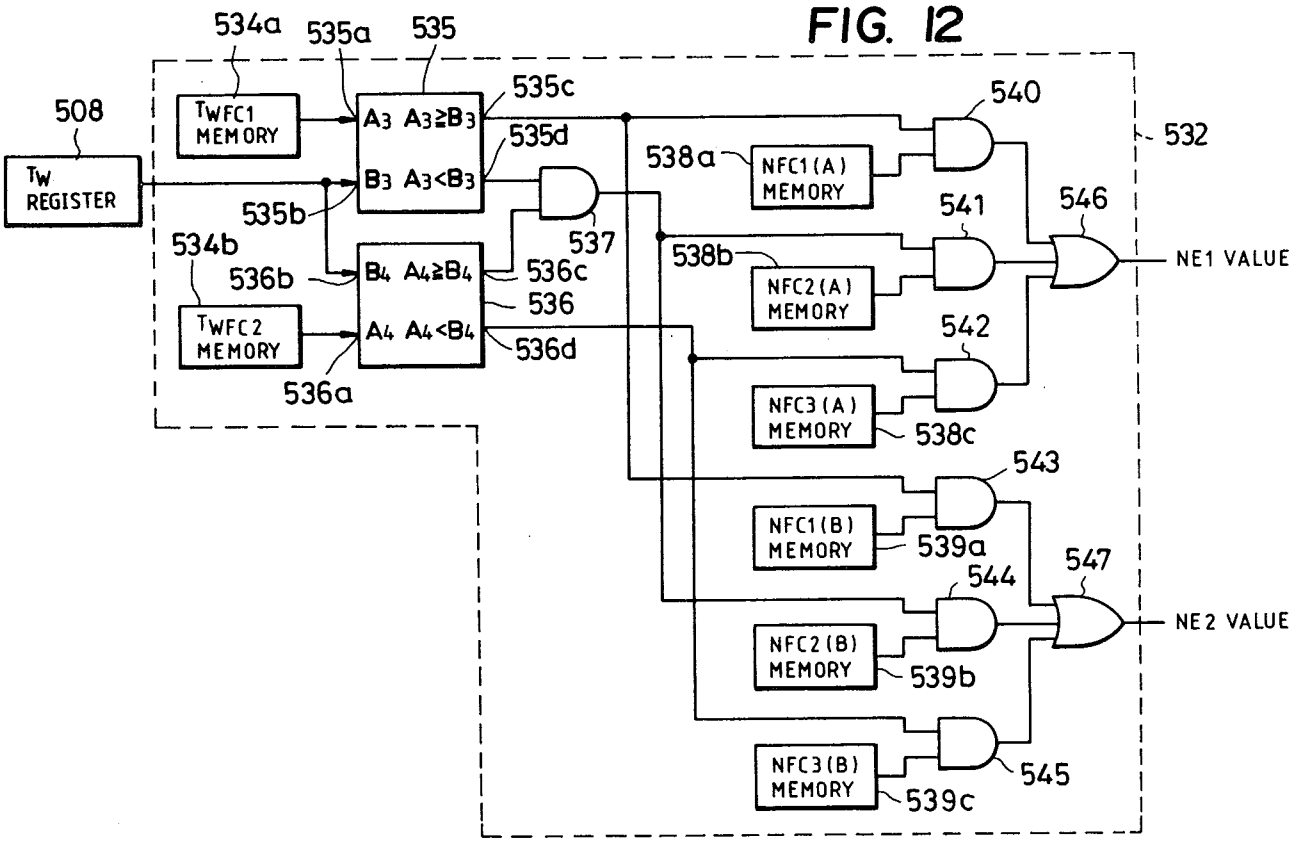
FIG. 12 is a circuit diagram illustrating in detail part of the fuel cut determining circuit.

FIG. 12 illustrates details of the block 532 containing the NE1 data memory 511 and the NE2 data memory 512 in Fig. 11. The block 532 determines the values of the fuel cut determining rpm NE1 and NE2 in dependence upon actual engine water temperature TW and supplies the determined values to the NE1 value register 515 and the NE2 value register 516 in FIG. 11. A TWFC1 value memory 534*a* and a TWFC2 value memory 534b store a first predetermined water temperature value TWFC1 (e.g. 20° C.) and a second predetermined water temperature value TWFC2 (e.g. 50° C.), respectively, which are plotted, by way of example, in FIG. 6 showing the NFCi-TW table. The stored values in the memories 534a and 534b are applied to respective comparators 535 and 536 at their input terminals 535a and 536a as inputs $A_3$ and $A_4$. The comparators 535 and 536 are supplied at their other input terminals 535b and 536b with an actual engine water temperature value TW outputted from the TW value register 508 in FIG. 9 as respective inputs $B_3$ and $B_4$ ($B_3=B_4$). The comparator 535 has an output terminal 535c connected to inputs of AND circuits 540 and 543. When the input relationship of $A_3 \geqq B_3$ (the first predetermined value TWFC1 ≧ the actual value TW), the comparator 535 applies an output of 1 to the AND circuits 540 and 543. The comparators 535 and 536 have output terminals 535d and 536c connected to inputs of AND circuits 541 and 544, respectively, by way of an AND circuit 537. Only when the input relationship of $A_3<B_3$ stands in the comparator 535 and simultaneously that of $A_4 \geqq B_4$ stands in the comparator 536, the AND circuit 537 applies an output of 1 to the AND circuits 541 and 544. The comparator 536 has another output terminal 536d connected to inputs of AND circuits 542 and 545. When the input relationship of $A_4<B_4$ stands, the comparator 536 applies an output of 1 to the AND circuits 542 and 545. The AND circuits 540–542 have their inputs also connected to an NFC1(A) value memory 538a, an NFC2(A) value memory 538b, and an NFC3(A) value memory 538c, respectively, and their outputs all connected to the NE1 value register 515 in FIG. 11 by way of an OR circuit 546. The AND circuits 543–545 have their inputs connected to an NFC1(B) value memory 539a, an NFC2(B) value memory 539b and an NFC3(B) value memory 539c, respectively, and their outputs all connected to the NE2 value register 516 in FIG. 11 by way of an OR circuit 547. As an example, the NFC1(A) value memory 538a stores a value of 2025 rpm (=NFC1+25 rpm), the NFC1(B) value memory 539a a value of 1975 rpm (=NFC1−25 rpm), the NFC2(A) value memory 538b a value of 1625 rpm (=NFC2+25 rpm), and the NFC2(B) value memory 539b a value of 1575 rpm (=NFC2−25 rpm), respectively. The NFC3(A) value memory 538c stores a value of 1225 rpm (=NFC3+25 rpm) and the NFC3(B) value memory 539c a value of 1175 (=FC3−25 rpm), respectively.

Assuming now that the actual engine water temperature has a value of 40° C., the comparator 535 is supplied with an input $A_3$ indicative of 20° C. and an input $B_3$ indicative of 40° C. so that the input relationship of $A_3<B_3$ stands, and accordingly generates an output of 0 through its output terminal 535c, and an output of 1 through its output terminal 535d, respectively, the former output being applied to the AND circuits 540 and 543, and the latter output to the AND circuit 537, respectively. On the other hand, the comparator 536 is supplied with an input $A_4$ indicative of 50° C. and an input $B_4$ indicative of 40° C. so that the input relationship of $A_4 \geqq B_4$ stands, and accordingly generates an output of 1 through its output terminal 536c and an output of 0 through its output terminal 536d, respectively, the former output being supplied to the AND circuit 537, and the latter one to the AND circuits 542 and 545, respectively. Thus, the AND circuit 537 is supplied at its two inputs with the above outputs of 1 to apply an output of 1 to the AND circuits 541 and 544 so that the value of 1625 rpm stored in the NFC2(A) value memory 538b is read into the NE1 value register 515, and the value of 1575 rpm stored in the NFC2(B) value memory 539b into the NE2 value register 516, respectively. Also when the engine water temperature TW has other values, similar operations to that described above will be carried out, description of which is therefore omitted.

Figure 13:
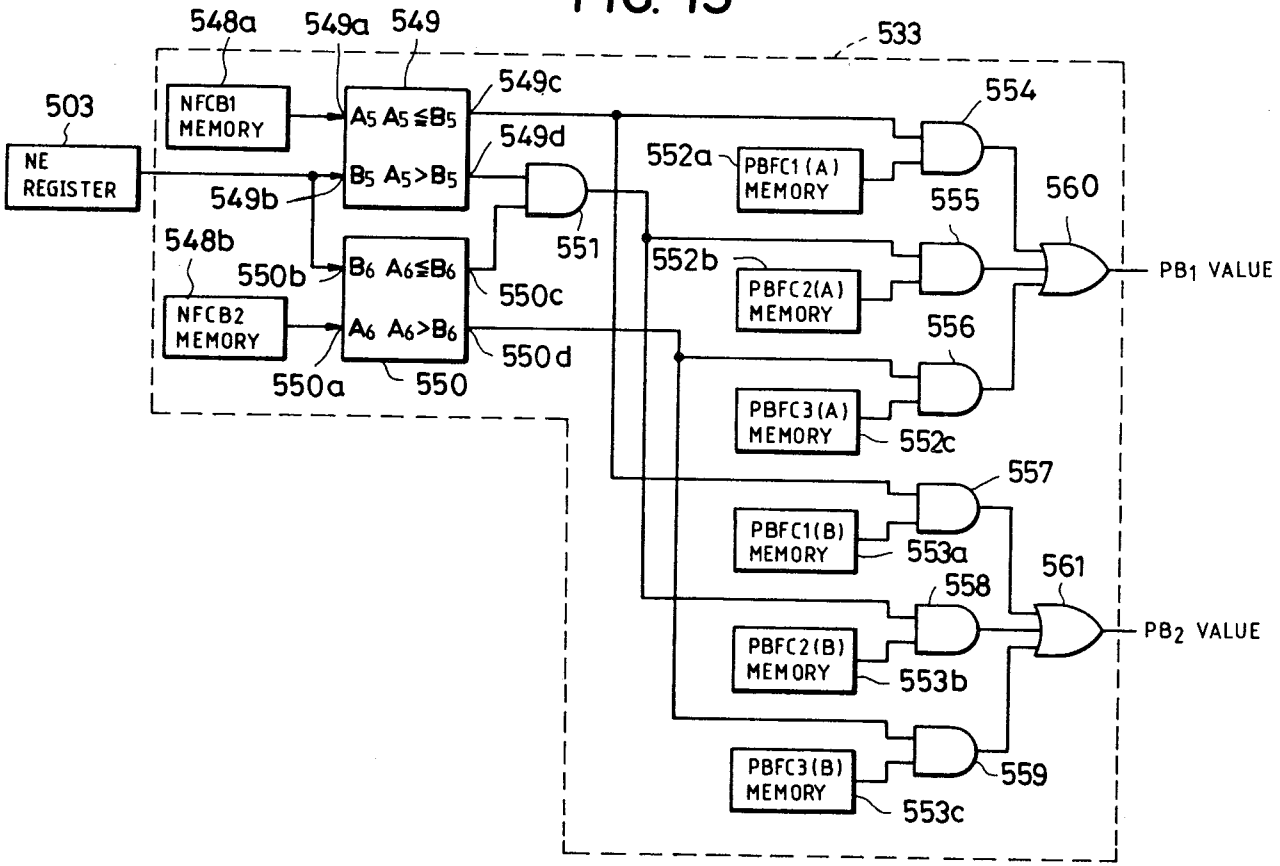
FIG. 13 is a circuit diagram illustrating in detail another part of the fuel cut determining circuit.

FIG. 13 illustrates details of the block 533 containing the PB1 data memory 513 and the PB2 data memory 514 in Fig. 11. The block 533 determines the values of the fuel cut determining absolute pressure PB1 and PB2 in dependence upon actual engine rpm Ne and supply the determined values to the PB1 value register 517 and the PB2 value register 518. An NFCB1 value memory 548a and an NFCB2 value memory 548b store a value of 1500 rpm and a value of 3000 rpm, respectively, which are plotted, by way of example, in FIG. 7 showing the NFCB-PBFCj table. The stored values in the memories 548a and 548b are applied to respective comparators 549 and 550 at their input terminals 549a and 550a as inputs $A_5$ and $A_6$. The comparators 549 and 550 are supplied at their other input terminals 549a and 550a with an actual engine rpm value Ne outputted from the NE value register 503 in FIG. 9 as respective inputs $B_5$ and $B_6$ ($B_5=B_6$). The comparator 549 has an output terminal 549c connected to inputs of AND circuits 554 and 557. When the input relationship of $A_5 \leqq B_5$ stands, the comparator 549 generates an output of 1 and applies it to the AND circuits 554 and 557. The comparators 549 and 550 have their output terminals 549d and 550c connected to inputs of AND circuits 555 and 558 by way of an AND circuit 551. Only when the input relationship of $A_5>B_5$ stands in the comparator 549 and simultaneously that of $A_6 \leqq B_6$ stands in the comparator 550, the AND circuit 551 applies an output of 1 to the AND circuits 556 and 559. The AND circuits 554–556 have their inputs connected to a PBFC1(A) value memory 552a, a PBFC2(A) value memory 552b and a PBFC3(A) value memory 552c, respectively, and their outputs all connected to the PB1 value register 517 in FIG. 11 by way of an OR circuit 560. The AND circuits 557–559 have their inputs connected to a PBFC1(B) value memory 553a, a PBFC2(B) value memory 553b and a PBFC3(B) value memory 553c, respectively, and their outputs all connected to the PB2 value register 518 in FIG. 11 by way of an OR circuit 561. As an example, the PBFC1(A) value memory 552a stores a value of 165 mmHg (=PBFC1−15 mmHg), the PBFC1(B) value memory 553a a value of 195 mmHg (=PBFC1+15 mmHg), the PBFC2(A) value memory 552b a value of 185 mmHg (=PBFC2−15 mmHg) and the PBFC2(B) value memory 553b a value of 215 mmHg (=PBFC2+15 mmHg), respectively. Further, the PBFC3(A) value memory 552c stores a value of 205 mmHg (=PBFC3−15 mmHg) and the PBFC3(B) value memory 553c a value of 235 mmHg (=PBFC3+15 mmHg), respectively.

Assuming now that the actual engine rpm Ne has a value of 2000 rpm, the comparator 549 is supplied with an input $A_5$ indicative of the reciprocal of the value of 1500 rpm and an input $B_5$ indicative of the reciprocal of the value of 2000 rpm so that the input relationship of $A_5>B_5$ stands, and accordingly generates an output of 0 through its output terminal 549c and an output of 1 through its output terminal 549d, respectively, the former output being applied to the AND circuits 554 and 557, and the latter one to the AND circuit 551, respectively. On the other hand, the comparator 550 is supplied with an input $A_6$ indicative of the reciprocal of the value of 3000 rpm and an input $B_6$ indicative of the reciprocal of the value of 2000 rpm so that the input relationship of $A_6 \leqq B_6$ stands, and accordingly generates an output of 1 through its output terminal 550*c* and an output of 0 through its output terminal 550*d*, respectively, the former output being applied to the AND circuit 551, and the latter one to the AND circuits 556 and 559, respectively. Thus, the AND circuit 551 is supplied at its two inputs with the above outputs of 1 to apply an output of 1 to the AND circuits 555 and 558 so that the value of 185 mmHg stored in the PBFC2(A) value memory 552*b* is read into the PB1 value register 517, and the value of 215 mmHg stored in the PBFC2(B) value memory 553*b* into the PB2 value register 518, respectively. Also when the engine rpm Ne has other values, similar operations to that described above will be carried out, description of which is therefore omitted.

What is claimed is:

1. In a fuel supply control system including a fuel injection device for injecting fuel into an internal combustion engine having an intake pipe, at least one throttle valve arranged in the intake pipe, an exhasust pipe, and a catalytic device arranged in the exhaust pipe for purifying exhaust gases, said catalytic device being of the type increasing in temperature with an increase in the amount of exhaust gases flowing into said catalytic device, said fuel supply control system being operable to electronically control said fuel injection device for control of the amount of fuel being supplied to said engine, a deceleration fuel cut device comprising:

means for detecting operating conditions of said engine, said detecting means including a first sensor for detecting the rotational speed of said engine and a second sensor arranged in the intake pipe of the engine at a location downstream of the throttle valve for detecting the pressure in said intake pipe of said engine;

means responsive to the outputs of said detecting means for determining a predetermined fuel cut condition, said fuel cut condition determining means being adapted to determine that said engine is in a condition requiring interruption of the supply of fuel to said engine when the engine rotational speed detected by said first sensor has a value higher than a predetermined value and simultaneously the intake pipe pressure detected by said second sensor has a value lower than a predetermined value above which the temperature of the catalytic device becomes excessively high, said predetermined intake pipe pressure value being set to higher values with an increase in the value of the engine rotational speed detected by said first sensor; and fuel cut means responsive to the result of said determination of said fuel cut condition determining means for causing said fuel injection device to cut off the supply of fuel to said engine.

2. The deceleration fuel cut device as claimed in claim 1, wherein said engine operating condition detecting means further includes a third sensor for detecting the temperature of said engine, and said predetermined engine rotational value is set to lower values with an increase in the value of the engine temperature detected by said third sensor.

3. The deceleration fuel cut device as claimed in any one of claim 1 or claim 2, wherein said predetermined engine rotational speed value is set at different values between the time when said fuel cut off means initiates cutting off the supply of fuel to said engine and the time when said fuel cut means terminates said cutting-off of the supply of fuel to said engine.

4. The deceleration fuel cut device as claimed in claim 1, wherein said predetermined intake pipe pressure value is set at different values between the time when said fuel cut means initiates cutting off the supply of fuel to said engine and the time when said fuel cut means terminates said cutting-off of the supply of fuel to said engine.

5. The deceleration fuel cut device as claimed in any one of claims 1 and 2, wherein said intake pipe pressure is detected as absolute pressure by said second sensor.

* * * * *